US010383375B2

(12) United States Patent
Williams

(10) Patent No.: US 10,383,375 B2
(45) **Date of Patent: *Aug. 20, 2019**

(54) ENVIRONMENTALLY RESPONSIVE FIBERS AND GARMENTS

(71) Applicant: NIKE, Inc., Beaverton, OR (US)

(72) Inventor: Patrick Williams, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 755 days.

This patent is subject to a terminal disclaimer.

(21) Appl. No.: 14/713,875

(22) Filed: May 15, 2015

(65) Prior Publication Data

US 2015/0245674 A1 Sep. 3, 2015

Related U.S. Application Data

(63) Continuation of application No. 13/531,151, filed on Jun. 22, 2012, now Pat. No. 9,090,998.

(51) Int. Cl.

| | |
|---|---|
| ***D01F 8/00*** | (2006.01) |
| ***A41D 13/002*** | (2006.01) |
| ***D01F 8/14*** | (2006.01) |
| ***D01D 5/253*** | (2006.01) |
| ***D01D 5/24*** | (2006.01) |
| ***A41D 31/14*** | (2019.01) |
| ***A41D 31/12*** | (2019.01) |

(52) U.S. Cl.

CPC ..... *A41D 13/002* (2013.01); *A41D 31/12* (2019.02); *A41D 31/14* (2019.02); *D01D 5/24* (2013.01); *D01D 5/253* (2013.01); *D01F 8/00* (2013.01); *D01F 8/14* (2013.01); *Y10T 428/2929* (2015.01); *Y10T 428/2931* (2015.01); *Y10T 442/3122* (2015.04); *Y10T 442/3146* (2015.04); *Y10T 442/444* (2015.04)

(58) Field of Classification Search

CPC ..... D01F 8/00–8/18

See application file for complete search history.

(56) References Cited

U.S. PATENT DOCUMENTS 5,741,590 A * 4/1998 Kobsa ..... D01F 8/12 428/373
7,754,626 B2 * 7/2010 Baron ..... A41D 27/28 442/181

(Continued)

FOREIGN PATENT DOCUMENTS

AT 252782 B 3/1967
CN 1701873 A 11/2005

(Continued)

OTHER PUBLICATIONS

JPS61083313A. Abstract and English Machine Translation. Jul. 26, 1986. (Year: 1986).*

(Continued)

*Primary Examiner* — Jenna L Johnson

(74) *Attorney, Agent, or Firm* — Shook, Hardy and Bacon LLP

(57) ABSTRACT

The present invention relates to a dynamic fiber/yarn capable of changing in response to external stimuli. The fiber/yarn in accordance with the present invention undergoes a radial symmetric change. The fiber/yarn in accordance with the present invention may be heat sensitive, moisture sensitive, magnetic field sensitive, electromagnetic field sensitive, etc.

20 Claims, 8 Drawing Sheets

(56) References Cited

U.S. PATENT DOCUMENTS

| | | | | |
|---|---|---|---|---|
| 7,842,628 | B2 * | 11/2010 | Yasui | A41B 17/00 442/181 |
| 7,976,924 | B2 | 7/2011 | Stanford, Jr. et al. | |
| 8,192,824 | B2 | 6/2012 | Rock et al. | |
| 2008/0057261 | A1 | 3/2008 | Rock | |
| 2009/0045042 | A1 * | 2/2009 | Browne | F16D 28/00 204/157.15 |
| 2011/0052861 | A1 * | 3/2011 | Rock | A41D 31/0033 428/92 |
| 2011/0068493 | A1 | 3/2011 | Buyuktanir et al. | |

FOREIGN PATENT DOCUMENTS

| | | | |
|---|---|---|---|
| CN | 101368664 | A | 2/2009 |
| EP | 1489642 | A1 | 10/2005 |
| GB | 1041706 | A | 9/1966 |
| JP | S6183313 | A | 4/1986 |
| JP | H06280157 | A | 10/1994 |
| JP | 2008057099 | A | 3/2008 |
| WO | 0224992 | A1 | 3/2002 |
| WO | 2006071023 | A1 | 7/2006 |
| WO | 2012044382 | A1 | 4/2012 |

OTHER PUBLICATIONS

Supplementary Partial European Search Report dated Jan. 16, 2016 in Application No. EP13807217.8, 7 pages.

International Search Report and Written Opinion dated Nov. 22, 2013 in Application No. PCT/US13/47078, 9 pages.

Non-Final Office Action dated Apr. 24, 2014 in U.S. Appl. No. 13/531,151, 9 pages.

Hu et al., "A review of stimuli-responsive polymers for smart textile applications"; Smart Materials and Structures; vol. 21, No. 5; Apr. 18, 2012, pp. 1-23; entire article, 2012 IOP Publishing Ltd. Printed in the UK & the USA.

Lee et al., "Spontaneous shape reconfigurations in multicompartmental microcylinders"; Proc Natl Acad Sci USA; vol. 109, No. 40; Oct. 2, 2012; 6 pages; entire article.

Notice of Allowance dated Apr. 10, 2015 in U.S. Appl. No. 13/531,151, 8 pages.

Australian Office Action dated Oct. 7, 2016 in Australian Patent Application No. 2013278055, 4 Pages.

European Search Report dated May 18, 2006 for European Patent Application No. 13807217.8, 6 pages.

Partial Search Report dated May 14, 2018 in European Patent Application No. 18153746.5, 14 pages.

* cited by examiner

ENVIRONMENTALLY RESPONSIVE FIBERS AND GARMENTS

CROSS-REFERENCE TO RELATED APPLICATIONS

This application is a Continuation Application of co-pending U.S. application Ser. No. 13/531,151, filed on Jun. 22, 2012 and entitled "Environmentally Responsive Fibers and Garments." The entirety of which is incorporated herein by reference.

STATEMENT REGARDING FEDERALLY SPONSORED RESEARCH OR DEVELOPMENT

Not applicable.

TECHNICAL FIELD

The present invention relates to shape-changing fibers that may be sensitive to different kinds of stimuli from the environment and to garments made using such fibers. The stimuli may include moisture, temperature, electric fields, magnetic fields, etc. The present invention offers several practical applications in the technical arts, not limited to adaptable comfort athletic garments. Small scale shape changes in the fibers in accordance with the present invention may have additive effects and be observable as a large scale change shape-changing fibers are incorporated into yarns and/or woven or knitted into a fabric/textile. Garments may be constructed from fabrics/textiles incorporating shape-changing fibers. Shape changes by incorporated fibers may alter a garment's wind and water permeability, color, moisture management properties, etc.

BACKGROUND OF THE INVENTION

Athletic apparel has evolved over time, and today treatments with different polymeric finishes or different kinds of synthetic yarns with specific physicochemical properties can be used in the manufacture of athletic apparel. In these examples, however, the physical properties of the fibers are substantially static over any given session of wearing a garment made using the fibers.

BRIEF SUMMARY OF THE INVENTION

The present invention generally relates to the production and use of fibers capable of undergoing a radial mechanical shape change in response to external stimuli such as heat, moisture, an electric field, a magnetic field, light, etc. The present invention further relates to garments that use such fibers to provide environmentally adaptive apparel. Fibers as described herein may be incorporated into yarns that may be knit or woven into fabric used to create such garments. Articles of manufacture beyond garments may likewise be made in accordance with the present invention incorporating adaptive fibers.

In accordance with the present invention, a multiple component synthetic polymer fiber may be provided. More specifically, the polymer fiber may comprise at least two synthetic polymers, each having different physicochemical properties from one another. According to the present invention, the synthetic polymer fiber may be manufactured by melt-spinning. The different polymers may, for example, be configured according to a predetermined orientation. Configuration of the different polymers may be performed inside a melting device that may be divided into multiple compartments corresponding to the final polymer configuration and shape of the fiber desired. The melting device may be, for example, a multicompartment crucible from which the polymer materials may be codrawn/extruded (drawn simultaneously) through an orifice of a predetermined size and shape for the desired fiber or fiber component. The fibers may be rapidly cooled so that the polymer materials may maintain their configuration and orientation in their solid state. Examples of fibers having first polymer and a second polymer are described herein, but the number of polymers and/or polymer shapes used in a fiber in accordance with the present invention are not limited to two. The fiber may be spun or otherwise collected to be used in a subsequent manufacturing step. The resulting fiber product may have varying physicochemical and mechanical properties in its radial direction.

Depending on the final configuration and orientation of the polymer materials desired, one of the polymers or an extruded fiber may be a removable filler polymer material. This sacrificial polymer material may aid in the manufacture of the fiber in accordance with the present invention by making the cross-sectional area of the initially extruded fiber, for example, essentially round so that it may be easier to collect and spin. The sacrificial polymer may be removed either before or after weaving a fabric/textile from the fibers and/or yarns incorporating fibers in accordance with the present invention. The sacrificial polymer, which may also be referred to as a filler polymer, may be removed selectively along a fiber, yarn, or garment to create zones with different properties on the ultimately created garment.

For example, in a fiber in accordance with the present invention the sacrificial polymer may be an acid-dissolvable polymer, with the other polymers being acid resistant. The sacrificial polymer may be removed by submitting the fiber (or yarns incorporating the fiber), prior to weaving a fabric/textile, to an acid bath. Or, alternatively, a woven fabric/textile comprising the raw fiber/yarn (still comprising the filler polymer), may be submitted to an acid bath to remove the sacrificial polymer. Alternatively, in different examples in accordance with the present invention, the sacrificial polymer may be base soluble, water soluble, oil soluble, etc. Accordingly, the fiber/yarn/textile/garment in accordance with the present invention may be submitted to the right substance for removing the filler polymer at one or more desired location.

In general, the cross-section of a fiber in accordance with the present invention may have any solid shape suitable for containing the radially distributed predetermined shape and orientation of the stimuli-sensitive polymer materials such as for example: circular, square, diamond, rectangle, etc. The stimuli-sensitive polymer materials contained inside the sacrificial polymer may be shaped and oriented in complex radial structures that are radially symmetric, and that are able to undergo mechanical changes in response to physicochemical changes induced by external stimuli. As a result, small changes manifested radially throughout the yarn may add up to tangible changes in a woven fabric/textile by multiplying the effect along the length of the fiber. Therefore, the fabric/textile comprising the yarn in accordance with the present invention may have a dynamic surface that when made into garments, the garments may be able to adjust or optimize conditions for a wearer in any given situation. The changes to the fiber may happen either automatically and/or may be user-controlled. For example, if the change in the fiber in accordance with the present invention is temperature induced, changes may be automatic as a function of the body temperature of the user, for example by making the fabric/textile moisture-wicking by exposing different fiber components, adjusting the level of insulation by making the fabric/textile more or less permeable to wind, water, etc.

The fiber in accordance with the present invention may comprise synthetic polymer materials such as, for example: polyesters, polyurethanes, polypropylenes, polyethylenes, nylons, other thermoplastic polymers, elastomers, etc., suitable for the manufacture of fibers and for inclusion in yarns/textiles/fabrics/garments.

Depending on the surface physical properties desired in a final fabric/textile product, the fabric/textile may be woven completely from the fiber/yarn in accordance with the present invention, or the fabric/textile may be woven from the fiber/yarn in accordance with the present invention and in combination with other types of fibers or yarns. For example, in order to obtain an extra resilient fabric/textile, the fiber in accordance with the present invention may be woven in combination with extra resilient aramid fibers, for example Kevlar®. If, for example, a natural "cottony feel" is desired in the final fabric/textile, the fabric/textile may be woven or knitted from the fiber in accordance with the present invention in combination with cotton fibers. The fiber in accordance with the present invention may be woven in combination with a fire resistant fiber/yarn to add a fire-resistance feature to the fabric/textile, etc., or the fiber in accordance with the present invention may be woven or knitted in combination with multiple types of specialty fibers or yarns such as the ones mentioned above, to obtain a multifunctional fabric/textile.

Fibers in accordance with the present invention may be incorporated into yarns that may be woven or knitted to form a fabric or textile. A yarn incorporating fibers in accordance with the present invention may comprise only shape-changing fibers or may incorporate shape-changing fibers in combination with other types of fibers. For example, the fiber in accordance with the present invention may also be formed into yarns or woven/knitted in combination with elastic fibers such as, for example, spandex, to give the woven fabric/textile elasticity. In other words, the fiber in accordance with the present invention may be combined with any other type of synthetic or natural fiber/yarn for the purposes of making a final fabric/textile with the specific desired properties. Further, fibers may be incorporated directly into a woven or knitted fabric/textile without incorporation into a multi-fiber yarn.

BRIEF DESCRIPTION OF THE SEVERAL VIEWS OF THE DRAWING

The present invention is described in detail below with reference to the attached drawing figures, wherein.

DETAILED DESCRIPTION OF THE INVENTION

The present invention relates to a novel fiber that undergoes radial physicochemical and a mechanical change in response to an external stimulus and yarns, textiles, fabrics, garments and/or articles of manufacture incorporating such fibers. The stimulus can be a change in temperature, moisture, the presence of an electromagnetic field, or a magnetic field, etc., to mention a few examples.

Figure 1:
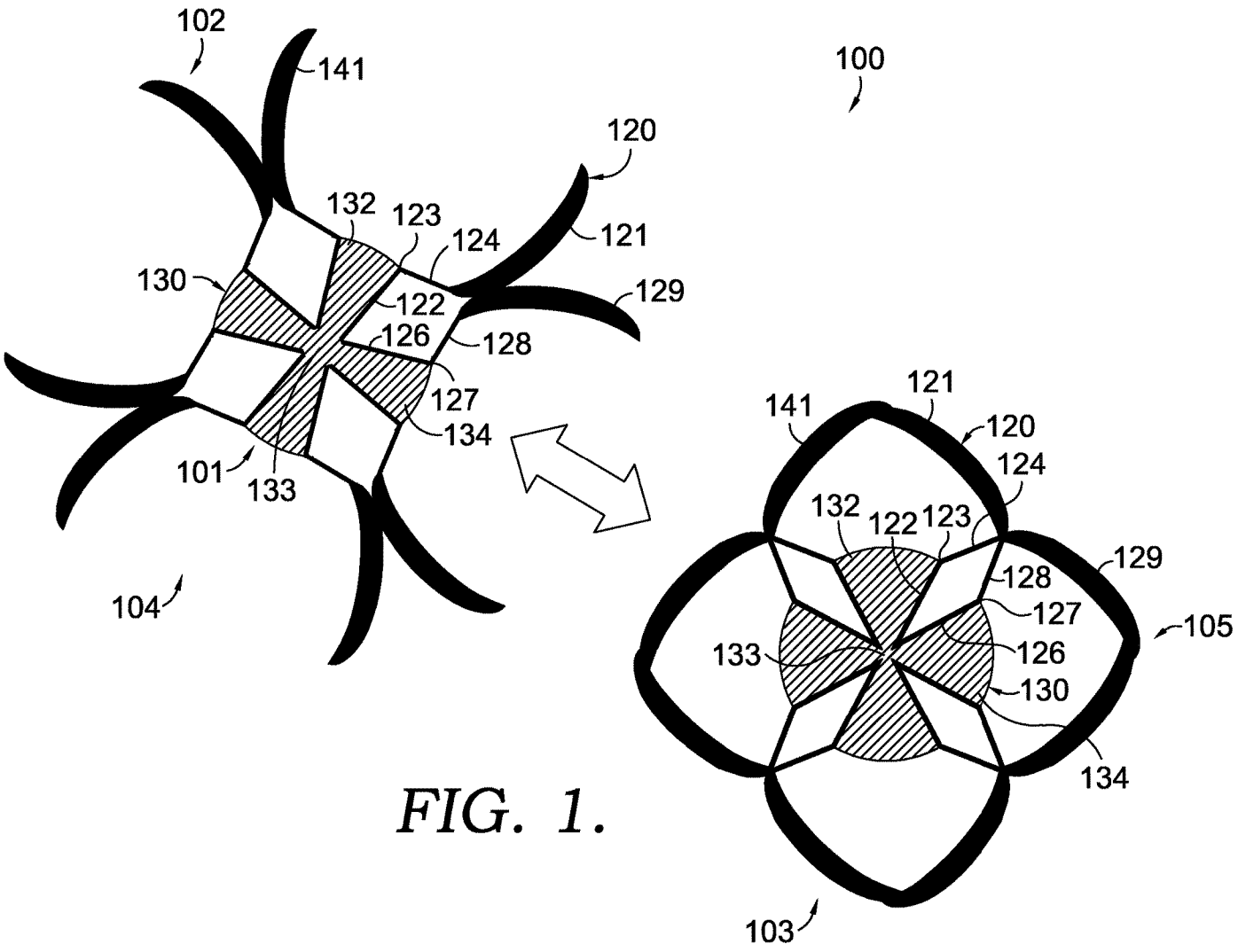
FIG. 1 is a cross-sectional view of a yarn or fiber in accordance with the present invention before and after a mechanical change has been induced by an external environmental stimulus.

In reference to FIG. 1, a cross-section of an exemplary composite stimuli-sensitive fiber 100 in accordance with the present invention is shown. Other configurations having different shapes, types, and numbers of components may be used without departing from the present invention. The composite stimuli-sensitive fiber 100 in FIG. 1 may comprise a first polymer material 130 located at the core of the fiber 100. The first polymer material 130 may be capable of undergoing a reversible physicochemical change in response to an external stimulus. In the example depicted in FIG. 1, first polymer material 130 takes the form of a cross with arms, such as first arm 132, second arm 134, etc., connected at a center 133. In addition to the first polymer material 130, the composite stimuli-sensitive fiber may additionally comprise a second polymer material 120 adjacent to the first polymer material 130. In the example depicted in FIG. 1, second polymer material 120 takes the form of pairs of horn-like protrusions extending in pairs from structures mechanically operative with arms, 132, 134, etc. of first polymer material 130. The second polymer material 120 may be capable of undergoing a mechanical change in direct response to the physicochemical change in the first polymer material 130. The mechanical change in the second polymer material 120 may be directly dependent on the shape and orientation of the second polymer material 120 in relation to the first polymer material 130. For example, as depicted in the example of FIG. 1, second polymer material 120 may take the form of diamond shaped portions between arms 132, 134, etc., of First polymer material 130. By way of further example, second polymer material 120 may comprise a first leg 122 connected at a first apex 123 to a first extension 124 at a first angle and a second leg 126 connected at a second apex 127 to a second extension 128 at a second angle. First leg 122 may be mechanically engaged with first arm 132 of first polymer material 130, while second leg 126 may be mechanically engaged with second arm 134 of first polymer material 130. When first arm 132 and second arm 134 expand, first leg 122 and second leg 126 are forced closer together, changing the angles of attachment at first apex 123 (between first leg 122 and first extension 124) and at second apex 127 (between second leg 126 and second extension 128). This mechanical action by the diamond shaped portions of second polymer 120 moves protrusions 121, 129, 141, etc., as illustrated in FIG. 1.

For example, in the fiber shown in FIG. 1, the first polymer material 130 located at the core of the fiber, may have a first shape 101 in the absence of an external stimulus, the first shape 101 of the first material 130 generally comprising at least four arms of substantially equal length, each arm progressively widening as the arm extends from the core. The second polymer material 120 may be adjacent, contacting, and mechanically engaged to the first polymer material 130 at least at one point so that the second material 120 having a second shape 102, may be in a first position in the absence of an external stimulus to the first material 130, and may be forced into a third shape 103 by the first material as the first material expands in response to an external stimulus.

The second polymer material 120 of the present example may generally have a shape that may form discrete hollow diamond shaped structures ending in two horn-like protrusions. For example, first leg 122 and first extension 124 may meet at a first apex 123 at a first angle, with a first protrusion 121 extending from first extension 124. Similarly, second leg 126 and second extension 128 may meet at a second apex at a second angle, with a second protrusion 129 extending from second extension 128. The hollow diamond shape may be mechanically engaged with the first polymer material 130 in each of the gaps between the arms of the first shape 101 of the first polymer material 130, for example at first arm 132 and first leg 122 and at second arm 134 and second leg 126. Since the first polymer material 130 and the second polymer material 120 are mechanically engaged, when the first polymer material 130 expands or contracts in response to an external stimulus, the hollow diamond shapes comprising the second polymer material 120 may be compressed (when the first material 130 expands) or released (when the first material 130 contracts) resulting in a mechanical motion that may be transmitted from, for example, first leg 122 and second leg 126 to first extension 124 and second extension 128, to ultimately move the horn like protrusions 121, 129 formed by the second material 120 to a first open position 104 (when the first material 130 is contracted) to a second closed position 102 (when the second material 120 is expanded). Any number of additional structures may be used in a fiber in accordance with the present invention. In other words, the changes induced by an external stimulus in the core first polymer material 130 start a "chain reaction" that effects a radial change throughout the whole length of the fiber, which in turn may alter the properties of a fabric/textile when the fiber is woven or knitted into a fabric/textile for use in the manufacture of articles of clothing, bags, protective cases, or any other type of article accommodating the type of fabric/textile woven from the fiber in accordance with the present invention.

References to materials or structures as "first" or "second" or the like are for purposes of description only, and do not imply primacy or order of creation, importance, or any consideration other than ease of description and understanding of a particular example. For example, while the example of FIG. 1 describes the polymer material at the core of a fiber as a first material 130 and the polymer material mechanically engaged with the core polymer material 130 as a second material 120, but other terminology may be used. Further, the relative positions of different materials may vary from the examples depicted herein. For example, rather than locating one type of material at a fiber core and another type of material at a fiber periphery, different types of materials may be located and mechanically engaged within a fiber core, around a fiber periphery, across the width of a fiber, etc. Also, any number of types of materials may be utilized within a fiber in accordance with the present invention.

Figure 2:
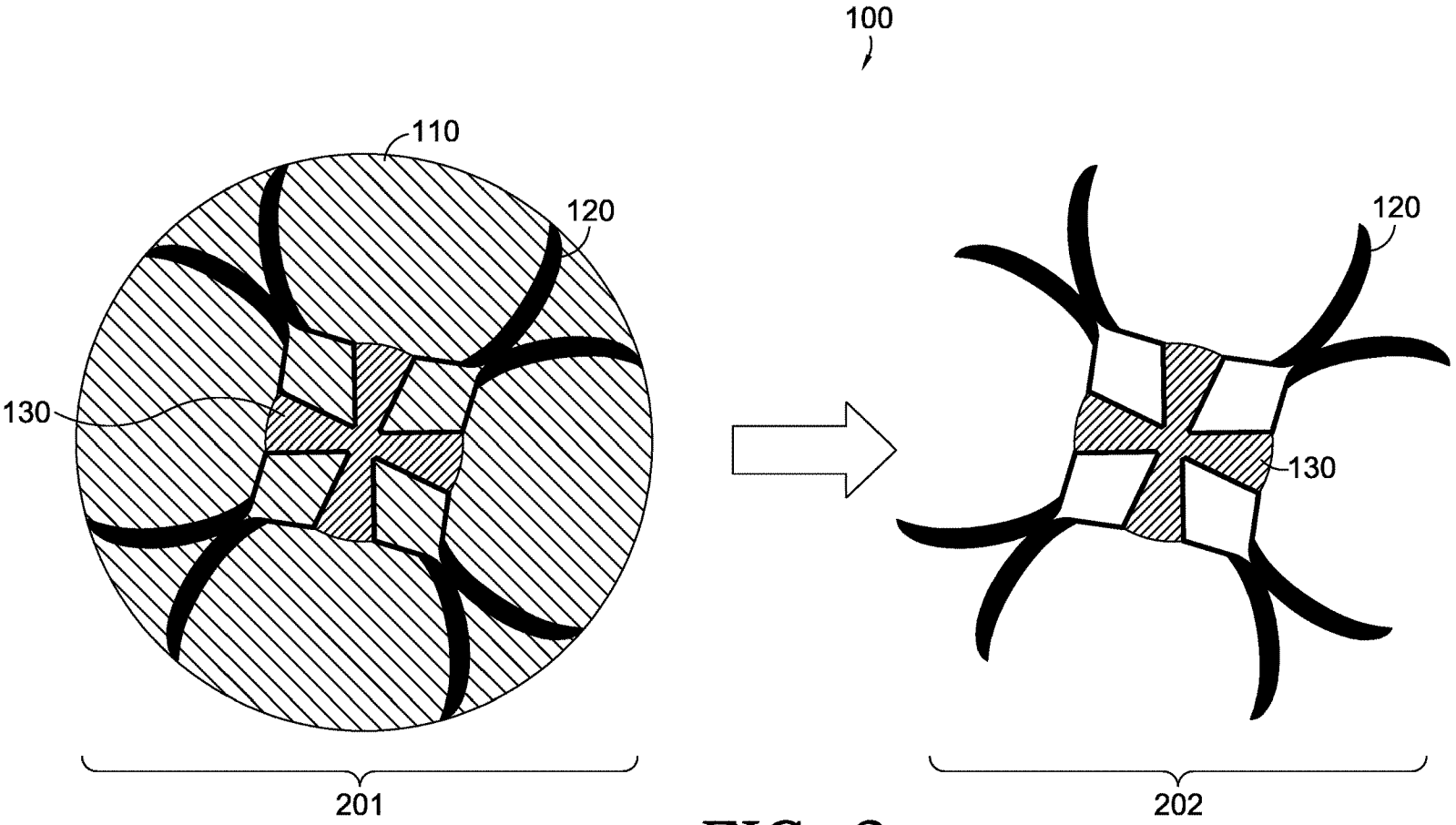
FIG. 2 is a cross-sectional view of a yarn or fiber in accordance with the present invention after extrusion and before and after treatment to dissolve away a filler polymer.

Now, in reference to FIG. 2, the fiber in accordance with the present invention may generally be manufactured by melt-spinning due to the nature of the polymer materials. The fiber in accordance with the present invention may have unique and fragile structures arranged and oriented according to a predetermined pattern suitable for the type of transformation desired. Due to the fragility of the radial shape of the fiber in accordance with the present invention, a removable third polymer material 110, may be used during manufacture of the fiber. The third polymer material 110, as seen in FIG. 2, may fill any of the gaps between the first polymer material 130 and the second polymer material 120 when the fiber is being extruded or melt-spun. The third polymer material 110 may aid in giving the extruded or melt-spun fiber a generally round cross-sectional area 201 but, as long as the cross-sectional area of the fiber is suitably filled, the cross-sectional area may be a square, oval, etc., or any other shape suitable for enclosing the complex fiber structures formed by the first polymers, second polymer, or other components of a fiber in accordance with the present invention.

The third polymer material 110 may comprise a sacrificial polymer that may be dissolvable without damaging the other polymers that make up the fiber. For example, if the first 130 and second 120 polymer materials are resistant to acid, the sacrificial third polymer material 110 may comprise a polymer that is dissolvable in an acid bath so that it may be easy to remove; or if the first 130 and second 120 polymer materials are base-resistant, the sacrificial third polymer material 110 may be a base-soluble polymer material. In a different example, the filler polymer material 110 may comprise a water soluble polymer so that it may be easily removed through washing with water, etc. Once the sacrificial third polymer material 110 is removed, the active cross-section form 202 of the fiber in accordance with the present invention is obtained.

The sacrificial third polymer material 110 may be removed from the fiber before forming a yarn and/or before weaving/knitting a fabric/textile from a fiber or a yarn incorporating the fiber. Alternatively, sacrificial third polymer material 110 may be removed after a fabric/textile has been woven or knitted from the fiber in accordance with the present invention, or the sacrificial polymer material 110 may be removed after the fabric/textile has been used to produce an article of manufacture. The sacrificial polymer material 110 may be removed selectively along a fiber, fabric/textile, and/or article of manufacture to create zones with different adaptability to environmental changes. In other words, the filler polymer material 110 may be removed in any step following the manufacture of the fiber in accordance with the present invention and the removable step may be adjusted according to the needs in the processing steps that follow.

Many different polymer materials that have the ability to contract and expand in response to an external stimulus may be used as the core first polymer material 130. For example, a magnetorheological polymer material may be used as the core first polymer material 130. The core magnetorhelological material may be a suspension of magnetic particles, or nanoparticles, where the suspension may be capable of undergoing a physical change in response to a magnetic field stimulus. For example, in known fluid magnetorheological materials, the viscosity of the fluid may increase at a predictable and proportional rate to the strength of the magnetic field applied, as the magnetic particles arrange themselves in the direction of the magnetic field. In the case of polymeric magnetorheological materials, the area occupied by the polymer may increase and decrease (expand or contract) in response to the presence or absence of a magnetic field. The magnetorheological material may be expanded in its "off" state and may contract in its "on" state when a magnetic field may be applied and the particles arrange themselves in the direction of the magnetic field.

Figure 3:
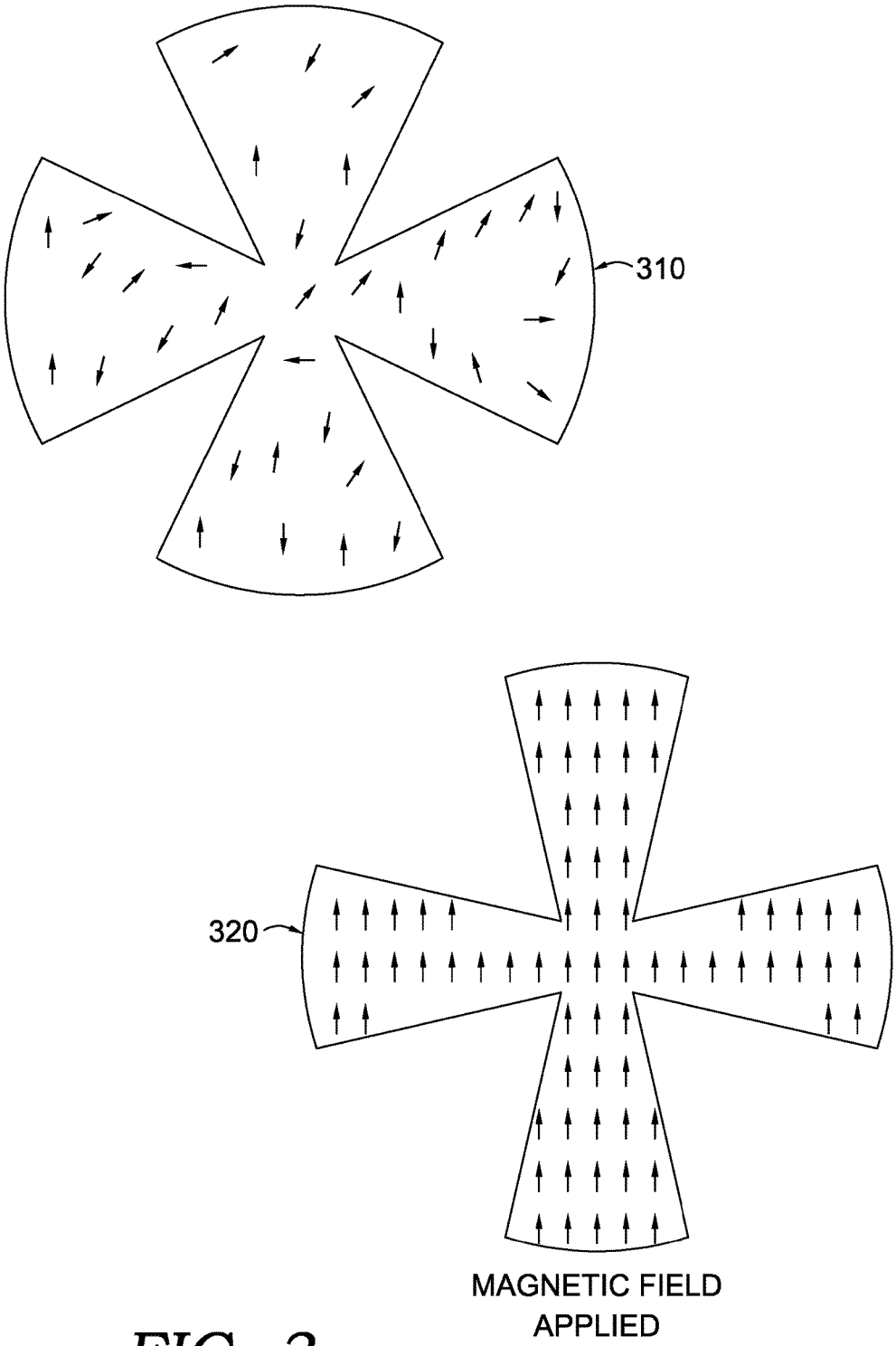
FIG. 3 is a close up view of the core first polymer material shown in FIG. 1 and FIG. 2, having magnetorheological properties presented in the "on" and "off" states.

If a magnetorheological material is used as the core first polymer material 130 in the fiber in accordance with the present invention, the fiber may microscopically radially change by applying a magnetic field on a fabric/textile incorporating this fiber. Referring to FIG. 1 again, in their off state the first 130 and second 120 polymer materials may be in a first closed position 102. Once a magnetic field is applied, the first 130 and second 120 polymer materials in their on state may change to a second open position 101, as the magnetic particles in the first polymer material 130 arrange themselves in the direction of the magnetic field. This feature may be better understood with the representative drawings in FIG. 3, where 310 is the off state and 320 is the on state, the off state 310 being when there is no magnetic field applied to the fiber, and the on state 320 being when a magnetic field is applied to the fiber. "Off" and "on" are merely relative states. The desired properties of a fiber, yarn, textile, and/or garment may be enabled by an "off" state or an "on" state, depending upon the materials and configurations used in a given fiber in accordance with the present invention.

The changes observable in the macroscopic change as an addition of all the microscopic changes happening at the fiber level may be observable when the fiber is incorporated into a fabric/textile. The macroscopic changes observed in a fabric/textile may be, for example, color changes (by employing different colored polymer materials as the first core polymer material and second mechanically engaged polymer material), level of insulation changes (by changing the "pore" size of the fabric/textile), fabric/textile feel changes (by shielding or exposing different polymer materials to the surface), etc. The changes may be controllable by the user since the magnetic field may be applied by the user by, for example, waving a physical magnet over the fabric/textile. As the magnetic field fades away, the first polymer material 130 may slowly revert back to its off state, which in turn, may return the original properties to the fabric/textile.

In a different example, the garment, or article of manufacture comprising a magnetorheological fiber in accordance with the present invention, may be engineered with electromagnetic field generating probes that may be turned on or off by providing a source of electricity such as a battery. In this example, a user may additionally be able to control the length of time desired for the change to take effect.

Figure 4:
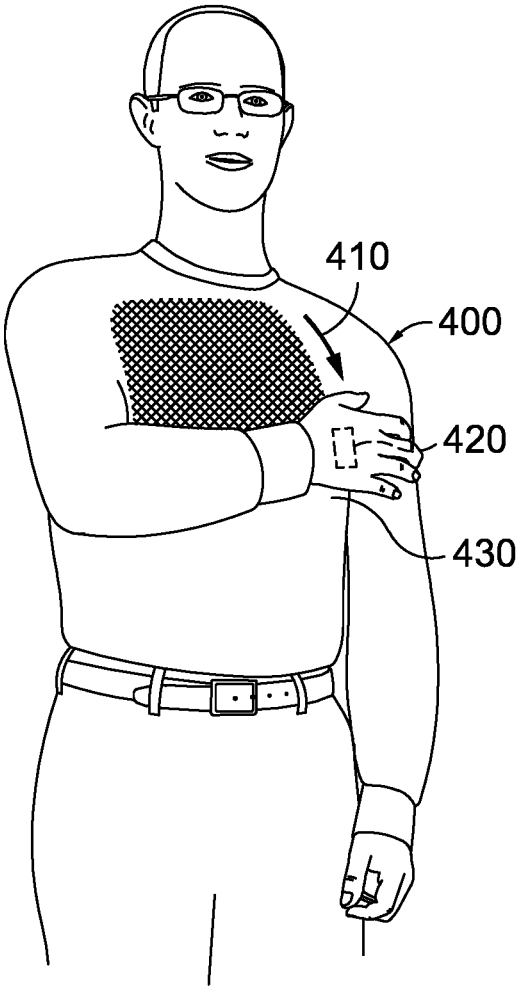
FIG. 4 is a representative garment made with a fabric/textile formed from a fiber/yarn in accordance with the present invention, with magnetorheological properties.

The magnetorheological properties of a fabric/textile incorporating a fiber in accordance with the present invention may be better understood in reference to FIG. 4, where a garment 400 with magnetorheological properties is shown. The properties of the fabric/textile making the garment may be changed, for example, by waving, as indicated by arrow 410, a magnet 420 over the textile 430. Alternatively, the change effects may be made to last longer, or the effects may be made controllable by, for example generating an electromagnetic field, which may be induced by including the necessary probes in the garment with a source of electricity such as a battery.

In a different example of a fiber in accordance with the present invention, a heat sensitive polymer material may be used as the core first polymer material 130. The heat sensitive polymer material may for example expand at temperatures slightly over normal body temperature, or any other temperature desired for the particular end purpose of a fabric/textile woven from a fiber in accordance with the present invention. Just as in the example presented above, for the use of magnetorheological polymer materials, a number of different changes, and a combination of changes may be manifested on a fabric/textile incorporating a fiber in accordance with the present invention. For example, both a color change and a change in the level of insulation may be observable in a garment in response to the wearer's body temperature increasing due to physical exertion. For example, if the first core polymer material 130 and the second mechanically engaged polymer material 120 shown in the example of FIG. 1 were different colors, the pore size of the fabric/textile may increase as the first and second polymer materials change from a first open position 104 to a closed position 105, while the second polymer material 120 is predominantly exposed to the surface of the fabric/textile. In other words, the color of the fabric/textile may change from being predominantly the color of the first core polymer 130, when open, to predominantly the color of the second mechanically engaged polymer 120 when closed.

Figure 5:
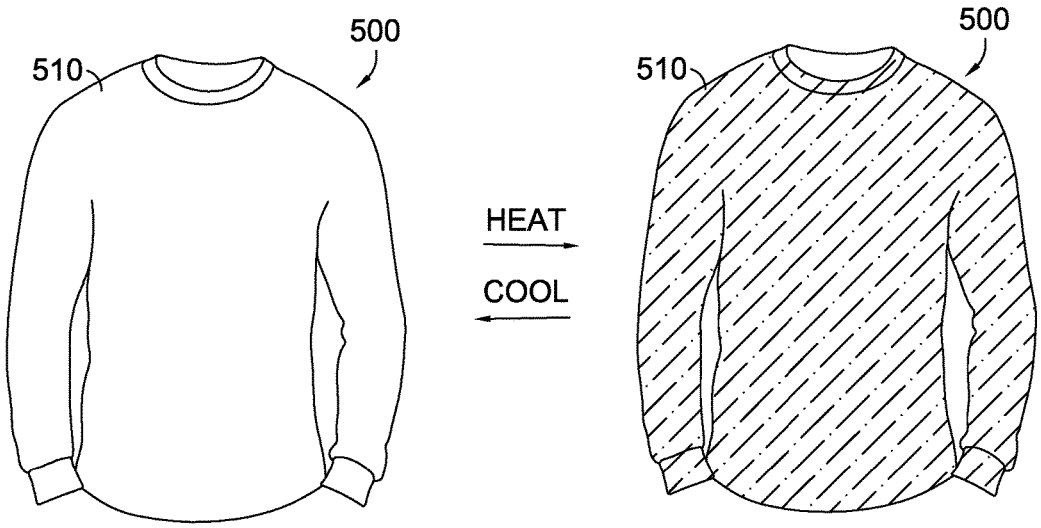
FIG. 5 is a representative garment made with a fabric/textile formed from a fiber/yarn in accordance with the present invention, with the external stimulus being temperature.

In a different example the core first polymer material 130 may be a heat-sensitive polymer material, and the second mechanically engaged polymer material 120 may be a moisture wicking polymer material so that, for example, a garment 500 made from a fabric/textile 510 incorporating fibers in accordance with the present example may have altered moisture management properties as the body temperature and perspiration of a wearer increases with increased physical exertion. This may be better understood in reference to FIG. 5, where a heat induced change in the properties of an athletic garment is represented. Thus, a fabric/textile incorporating fibers in accordance with the present invention may dynamically adjust to the particular needs of the end product of manufacture.

In a different example, the core first polymer material 130 may be a moisture sensitive polymer material that may expand or contract in response to the presence or absence of moisture, either from body perspiration or, alternatively, from environmental sources, such as rain, fog, etc. If the fiber is made to be sensitive to perspiration, for example, a polymer that expands in response to the presence of moisture may be used for the core first polymer material 130 to decrease the level of insulation, and a moisture wicking polymer material may be used as the second mechanically engaged polymer material 120 to improve the moisture management properties of the fiber/yarn and fabric/textile incorporating the fiber.

Figure 6:
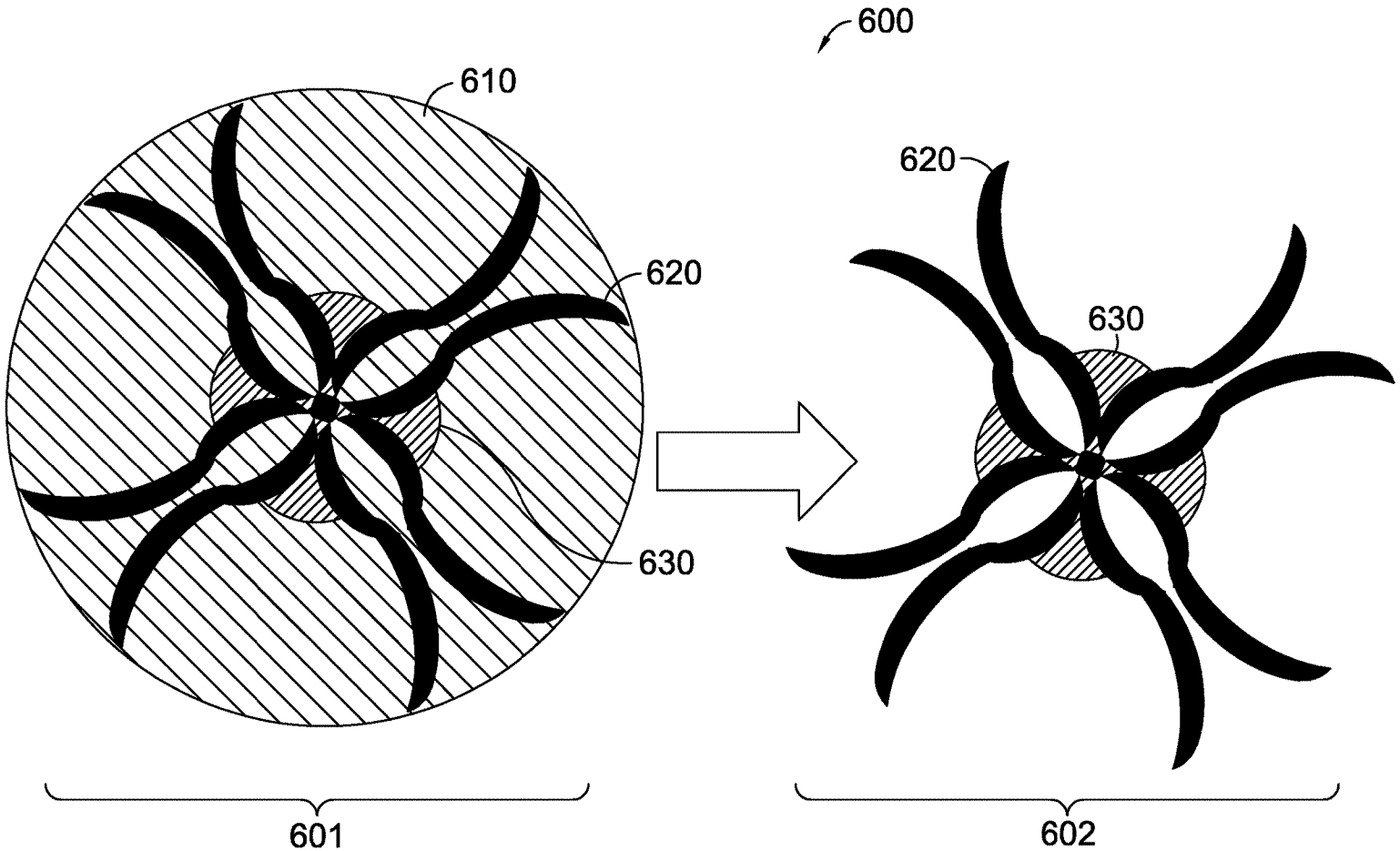
FIG. 6 is a cross-sectional view of a different yarn or fiber in accordance with the present invention after extrusion and before and after treatment to dissolve away a filler polymer.

In FIG. 6 a cross-section of a different exemplary composite stimuli-sensitive fiber 600 with a different configuration, is shown. Like the composite stimuli-sensitive fiber 100 described in FIG. 2, the fiber 600 in accordance with the present invention may generally be manufactured by melt-spinning, extrusion, or any other suitable method. The fiber 600 in accordance with the present invention may comprise at least three different kinds of polymer materials. The composite stimuli-sensitive fiber 600 in FIG. 6 may comprise a first polymer material 630 located at the core of the fiber 600. The first polymer material 630 may be capable of undergoing a reversible physicochemical change in response to an external stimulus. The composite stimuli-sensitive fiber 600 may additionally comprise a second polymer material 620 adjacent to the first polymer material 630. Since the first polymer material 630 and the second polymer material 620 in the fiber 600 may have unique and fragile structures arranged and oriented according to a predetermined pattern suitable for the type of transformation desired, a sacrificial third filler polymer material 610 may be used during manufacture of the fiber 600. The sacrificial polymer material 610, as seen in FIG. 6, may fill any of the gaps between the first polymer material 630 and the second polymer material 620 when the fiber is being extruded or melt-spun. The sacrificial polymer material 610 may aid in giving the extruded or melt-spun fiber a generally round cross-sectional area 601 but, as long as the cross-sectional area of the fiber is suitably filled, the cross-sectional area may be a square, oval, etc., or any other shape suitable for enclosing the complex fiber structures formed by the first polymers, second polymer, or other components of a fiber in accordance with the present invention.

The sacrificial polymer material 610 may be a polymer that may be dissolvable without damaging the other polymers that make up the fiber. For example, if the first polymer material 630 and second polymer material 620 are resistant to acid, the sacrificial polymer material 610 may comprise a polymer that is dissolvable in an acid bath so that it may be easy to remove; or if the first 630 and second 620 polymer materials are base-resistant, the sacrificial polymer material 610 may be a base-soluble polymer material. In a different example, the sacrificial polymer material 610 may comprise a water soluble polymer so that it may be easily removed through washing with water, etc. Once the sacrificial polymer material 610 is removed, the active cross-section form 602 of the fiber in accordance with the present invention may be obtained.

Figure 7:
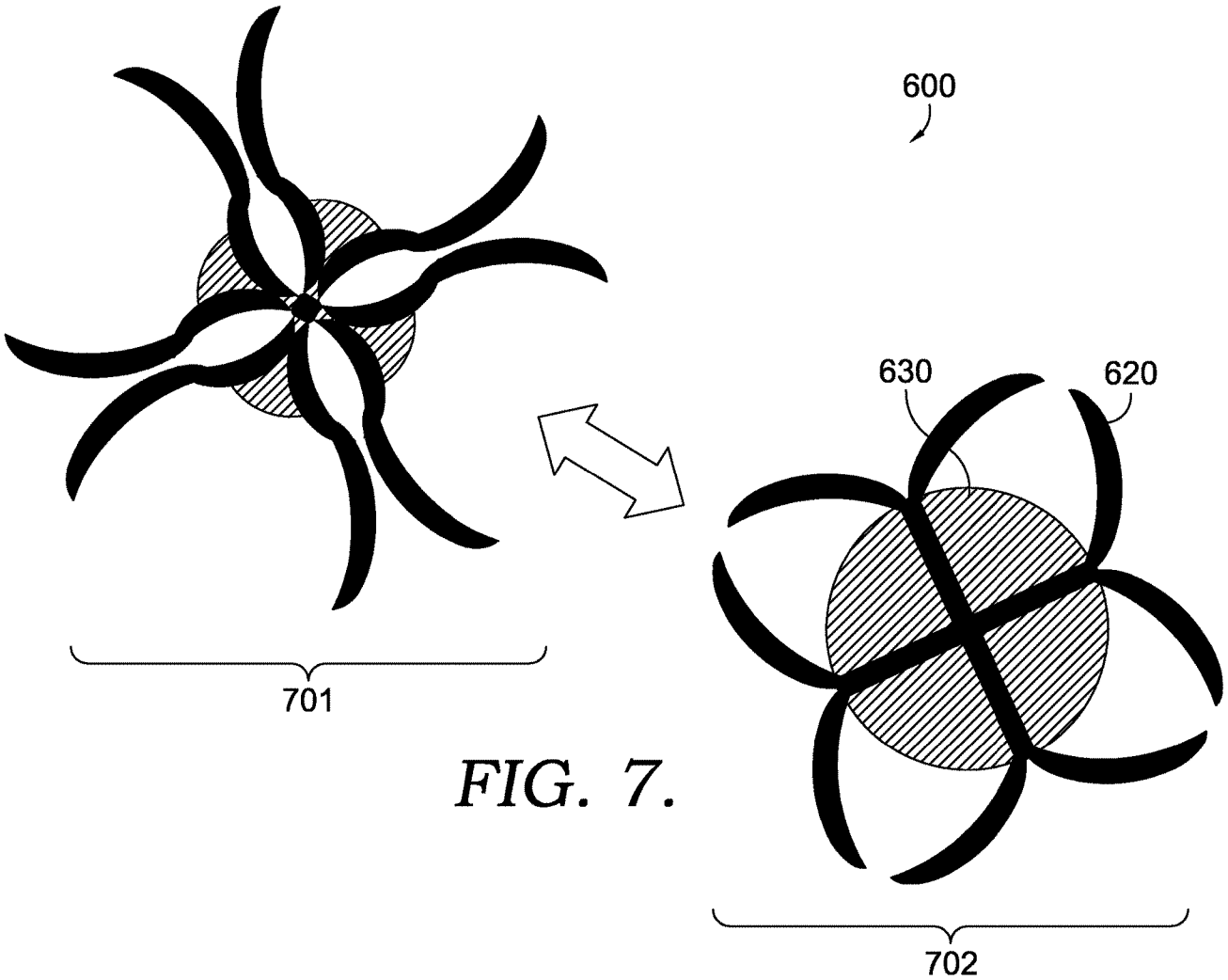
FIG. 7 is a cross-sectional view of the yarn or fiber in FIG. 6 in accordance with the present invention before and after a mechanical change has been induced by an external environmental stimulus.

In FIG. 7 a cross-section of the exemplary composite stimuli-sensitive fiber 600 in its active configuration with the sacrificial polymer material 610 dissolved away is shown. The composite stimuli-sensitive fiber 600 in FIG. 7 comprises a first polymer material 630 and a second polymer material 620 adjacent to the first polymer material 630. In the example depicted in FIG. 6, the second polymer material 620 takes the form of pairs of horn-like projections extending in pairs from structures mechanically operative with physical changes in the first polymer material 630. In other words, the composite fiber 600 in this example may undergo a structural change from a first structure 701 to a second structure 702, as a response to a given physical change in the first polymer material 630.

Figure 8:
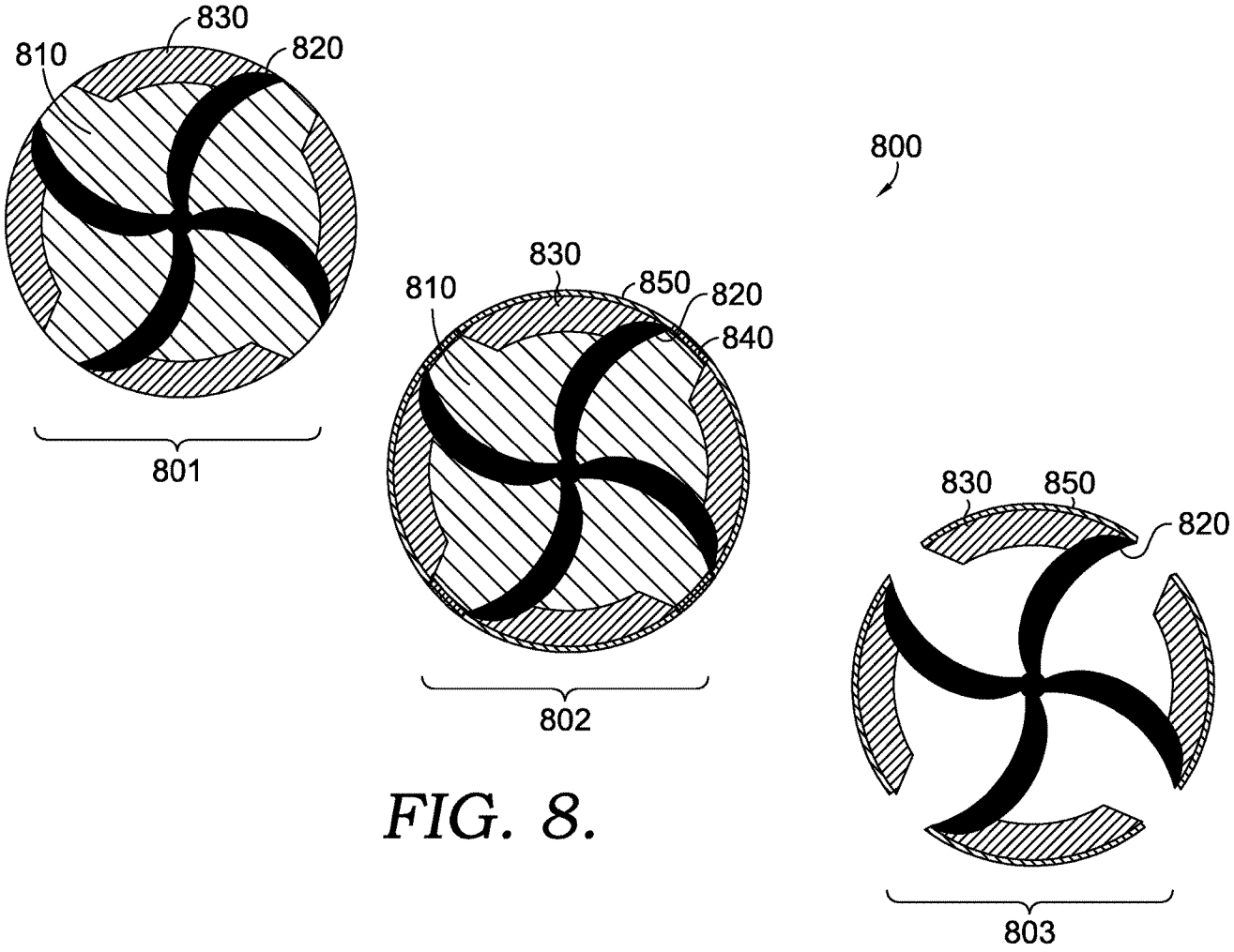
FIG. 8 is a cross-sectional view of a further different yarn or fiber in accordance with the present invention.

FIG. 8 is yet another example of a composite fiber 800 in accordance with the present invention. In this example, the composite fiber 800 may first be extruded or melt-spun comprising a first polymer material 810, a second polymer material 820, and a third polymer material 830, shown collectively as 801, wherein the first polymer material 810 may be a sacrificial polymer material. Before removal of the first polymer material 810, the composite fiber 800 may first undergo a finishing process to impart additional desirable properties such as water resistance, fire resistance, etc. Such finishing processes may be chemical and/or mechanical. Examples of possible chemical finishes that may be used in accordance with the present invention are softeners, absorbency finishes, resin finishes, oil repellant finishes, water repellant finishes, ultra-violet protective finishes, various types of coatings, laminations, etc. Chemical finishes may be applied at a fiber, yarn, textile, partially constructed item, and/or fully constructed item stage of manufacturing. Chemical finishes may be applied with any technique, such as a bath, a spray, contact application by pads or other mechanisms, by using adhesives or bonding agents, etc. Examples of possible mechanical finishes that may be used in accordance with the present invention are calendaring, compacting, peaching, sueding, sanding, brushing, shearing, embossing, etc. Mechanical finishes may be applied at a fiber, yarn, textile, partially constructed item, and/or fully constructed item stage of manufacturing. More than a single type of finish may be applied to a fiber/yarn/textile/item. The resulting fiber after finishing is shown collectively as 802. The finish applied may add material to fiber 800 or may modify the surface of fiber 800, as generally shown as 802. Because a finish may, but need not, interact differently to different materials, a first finished surface 840 may be formed over first polymer material and a second finished surface 850 may be formed over third polymer material 830. Additional finished surfaces may be formed over additional materials of a fiber exposed to a finish. After the finishing step has been completed, the first polymer material 810 may then be dissolved/removed by any suitable method that will remove the first polymer material 810 and finish layer 840 over sacrificial first polymer material 810. As a result, a fiber 803 having the second polymer material 820 and the third polymer material 830 with the desired finish layer 850 may be obtained in their active configurations, as shown as 803 while removing sacrificial first polymer material 810 and coating layer 840 overlaying the now removed sacrificial polymer material 810. As a result, both finished and unfinished surfaces are present in fiber 803, such that mechanical changes, such as described above, may expose different types of surfaces to alter the properties of the fiber.

Additional objects, advantages, and novel features of the invention will be set forth in part in the description which follows, and in part will become apparent to those skilled in the art upon examination of the following, or may be learned by practice of the invention.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible uses may be made of the invention without departing from the scope thereof, it is to be understood that all matter herein set forth or shown in the accompanying drawings is to be interpreted as illustrative and not in a limiting sense.

Having thus described the invention, what is claimed is:

1. A stimuli-sensitive composite fiber comprising at least two different types of polymer materials:

a stimuli-sensitive polymer material capable of undergoing a cross-sectional reversible and radially symmetric physical change, the stimuli-sensitive polymer material being located at a core of the stimuli-sensitive composite fiber, the stimuli-sensitive polymer material comprising a first cross-sectional and radially symmetric shape in the absence of an external stimulus and a second cross-sectional and radially symmetric shape in the presence of the external stimulus; and a second polymer material having a third cross-sectional and radially symmetric shape in the absence of the external stimulus and a fourth cross-sectional and radially symmetric shape in the presence of the external stimulus, wherein a transition from the third cross-sectional and radially symmetric shape to the fourth cross-sectional and radially symmetric shape in the second polymer material is induced by the change from the first cross-sectional and radially symmetric shape to the second cross-sectional and radially symmetric shape of the stimuli-sensitive polymer material.

2. The stimuli-sensitive composite fiber of claim 1, wherein the stimuli-sensitive polymer material transitions from the first cross-sectional and radially symmetric shape to the second cross-sectional and radially symmetric shape in response to heat.

3. The stimuli-sensitive composite fiber of claim 1, wherein the stimuli-sensitive polymer material transitions from the first cross-sectional and radially symmetric shape to the second cross-sectional and radially symmetric shape in response to moisture.

4. The stimuli-sensitive composite fiber of claim 1, wherein the stimuli-sensitive polymer material transitions from the first cross-sectional and radially symmetric shape to the second cross-sectional and radially symmetric shape in response to an electromagnetic field.

5. The stimuli-sensitive composite fiber of claim 1, wherein the stimuli-sensitive polymer material and the second polymer material comprise polyesters.

6. The stimuli-sensitive composite fiber of claim 1, wherein the third cross-sectional and radially symmetric shape of the second polymer material comprises protrusions that change position in response to a force exerted by the second cross-sectional and radially symmetric shape of the stimuli-sensitive polymer material on the third cross-sectional and radially symmetric shape of the second polymer material, to form the fourth cross-sectional and radially symmetric shape of the second polymer material.

7. The stimuli-sensitive composite fiber of claim 1, wherein the stimuli-sensitive composite fiber further comprises a finish layer on at least a portion of a perimeter of the stimuli-sensitive composite fiber.

8. The stimuli-sensitive composite fiber of claim 1, wherein the stimuli-sensitive polymer material is a first color and wherein the second polymer material is a second color.

9. The stimuli-sensitive composite fiber of claim 8, wherein the reversible physical change in the stimuli-sensitive polymer material induces a reversible color change in the stimuli-sensitive composite fiber from the first color of the stimuli-sensitive polymer material to the second color of the second polymer material.

10. A garment comprising a stimuli-sensitive composite fiber capable of undergoing a cross-sectional and radially symmetric reversible physical change, the stimuli-sensitive composite fiber's cross-sectional area comprising:

a first material at a core of the stimuli-sensitive composite fiber, the first material capable of undergoing a physicochemical change in response to an external stimulus, wherein the first material comprises a first cross-sectional and radially symmetric shape in the absence of the external stimulus, and wherein the first material comprises a second cross-sectional and radially symmetric shape in the presence of the external stimulus; and a second material comprising a third cross-sectional and radially symmetric shape in the absence of the external stimulus and a fourth cross-sectional and radially symmetric shape in the presence of the external stimulus, wherein the second material is adjacent to the first material, and wherein in the presence of the external stimulus, the physicochemical change in the first material causes a mechanical shift in the second material from the third cross-sectional and radially symmetric shape to the fourth cross-sectional and radially symmetric shape.

11. The garment of claim 10, wherein the stimuli-sensitive composite fiber further comprises a finish layer on at least a portion of a perimeter of the stimuli-sensitive composite fiber.

12. The garment of claim 10, wherein the first material undergoes the physicochemical change in response to heat.

13. The garment of claim 10, wherein the first material undergoes the physicochemical change in response to moisture.

14. The garment of claim 10, wherein the first material undergoes the physicochemical change in response to an electromagnetic field.

15. The garment of claim 10, wherein the first material and the second material comprise polyesters.

16. A stimuli-sensitive composite fiber capable of undergoing a cross-sectional and radially symmetric reversible physical change, the stimuli-sensitive composite fiber's cross-sectional area comprising:

a first material at a core of the fiber, the first material capable of undergoing a physicochemical change in response to an external stimulus, wherein the first material comprises a first cross-sectional and radially symmetric shape in the absence of the external stimulus, and wherein the first material comprises a second cross-sectional and radially symmetric shape in the presence of the external stimulus; and a second material that is adjacent to the first material, and wherein in the presence of the external stimulus, the physicochemical change in the first material causes a mechanical shift in the second material from a third cross-sectional and radially symmetric shape to a fourth cross-sectional and radially symmetric shape.

17. The stimuli-sensitive composite fiber of claim 16, wherein the first material undergoes the physicochemical change in response to heat.

18. The stimuli-sensitive composite fiber of claim 16, wherein the first material undergoes the physicochemical change in response to moisture.

19. The stimuli-sensitive composite fiber of claim 16, wherein the first material undergoes the physicochemical change in response to an electromagnetic field.

20. The stimuli-sensitive composite fiber of claim 16, wherein the stimuli-sensitive composite fiber further comprises a finish layer on at least a portion of a perimeter of the stimuli-sensitive composite fiber.

* * * * *